US006854606B2

(12) United States Patent
Robertson

(10) Patent No.: US 6,854,606 B2
(45) Date of Patent: Feb. 15, 2005

(54) MOVEABLE STORAGE AND DISPLAY RACK FOR ROLLED FLOORING MATERIALS

(76) Inventor: David H. Robertson, 1720 H. St., Fresno, CA (US) 93721

( * ) Notice: Subject to any disclaimer, the term of this patent is extended or adjusted under 35 U.S.C. 154(b) by 0 days.

(21) Appl. No.: 10/340,084

(22) Filed: Jan. 9, 2003

(65) Prior Publication Data

US 2004/0134868 A1 Jul. 15, 2004

(51) Int. Cl.[7] ..... A47F 7/00; A47F 7/18
(52) U.S. Cl. ..... 211/60.1; 211/44; 211/49.1
(58) Field of Search ..... 211/60.1, 44, 13.1, 211/27–29, 85.18, 191, 41.14; 312/107, 285; 280/79.3; 206/446

(56) References Cited

U.S. PATENT DOCUMENTS 2,135,540 A * 11/1938 Smith ..... 242/594.6
2,450,180 A * 9/1948 Bixer ..... 211/44
2,593,472 A * 4/1952 McGinn ..... 211/85.5
2,646,174 A * 7/1953 Hutten et al. ..... 211/44
2,839,198 A * 6/1958 Lefevre ..... 211/41.14
3,951,276 A 4/1976 Moses
4,004,701 A 1/1977 Moses
4,626,017 A * 12/1986 Robertson ..... 296/3
4,783,017 A 11/1988 Ovitz, III
5,411,360 A * 5/1995 Hilliker et al. ..... 414/608
5,590,435 A * 1/1997 Kostigian ..... 15/40
5,906,282 A * 5/1999 Aldrich et al. ..... 211/41.14
6,170,672 B1 * 1/2001 Boettcher ..... 211/13.1
6,202,863 B1 * 3/2001 Grenier ..... 211/70.4
6,383,376 B1 * 5/2002 Beauchamp ..... 210/189
6,536,607 B1 * 3/2003 Knoll et al. ..... 211/41.14
6,585,224 B1 * 7/2003 Schmidt ..... 248/640
6,607,083 B1 * 8/2003 Webb ..... 211/59.2
2003/0196971 A1 * 10/2003 Jeskey et al. ..... 211/41.14

* cited by examiner

*Primary Examiner*—Carl D. Friedman
*Assistant Examiner*—Jennifer E. Novosad
(74) *Attorney, Agent, or Firm*—Richard A. Ryan

(57) ABSTRACT

A rack for storing, moving and displaying rolled flooring materials, such as carpet, carpet remnants and pad, having a frame with a plurality of frame members configured to hold flooring materials in either a vertical or horizontal configuration. The frame has an upper section with a stinger receiving mechanism configured to receive a stinger pole attached to a forklift. The stinger receiving mechanism can comprise a shaped portion of the frame or a shaped member or a tubular member attached to the frame for lifting the frame and its contents. The bottom section of the frame can comprise a prong receiving mechanism configured for receiving the prongs of a forklift. The rack can also include one or more movement guides for moving the rack with the stinger and/or one or more roll support members attached to the frame for displaying rolls of material.

25 Claims, 4 Drawing Sheets

MOVEABLE STORAGE AND DISPLAY RACK FOR ROLLED FLOORING MATERIALS

BACKGROUND OF THE INVENTION

A. Field of the Invention

The field of the present invention relates generally to racks for storing, moving and displaying rolled materials, such as carpet, carpet remnants and carpet pad. More particularly, the present invention relates to such racks which are suitable for storing, moving and displaying rolled flooring materials in either a vertical or horizontal position. Even more particularly, the present invention relates to such racks that are configured to be used with a stinger-type apparatuses commonly used to move rolls of carpet and other flooring materials.

B. Background

Many flooring materials are sold, stored, moved and displayed in elongated rolls of such materials. For instance, as is well known in the carpet and related industries, it is very common to sell, store, move and display carpet and carpet related materials, including carpet, carpet remnants and carpet pad, in an elongated roll of the material. Also included in the general category of flooring materials are other forms of floor coverings, such as linoleum, vinyl flooring and the like that are also supplied in elongated rolls of the material. For purposes of this disclosure, the term flooring materials refers to all such materials.

Flooring materials are typically delivered by the manufacturer to the flooring wholesaler or retailer in the form of large elongated rolls. After the rolls are received by the wholesaler or retailer, they are moved into storage or into a showroom for display. Naturally, it is preferred to display the materials in a way that most beneficially allows the purchaser to review the materials so that they may consider which materials to purchase. After the flooring material buyer selects the type and amount of flooring material they desire, the flooring material is delivered to the buyer and installed in the buyers preferred location, such as a house or office. As is well known in the industry, it is often necessary to move the rolls of flooring materials from one location to another before the materials are purchased, depending on the need to make room for other materials, deliver materials to a purchaser or place the materials in a different location for purposes of better displaying that material.

With regard to the purchase of flooring materials by a buyer, the typical buyer does not purchase an entire roll or, if buying multiple rolls, full rolls of the flooring material. As a result some of the flooring material on a roll is usually left behind to be sold by the wholesaler or retailer. The left behind materials are commonly referred to as remnants. Naturally, the wholesaler or retailer desires to sell these remnants so as to fully maximize his or her profit on the flooring materials. In order to do so, it is necessary to selectively display the remnants in a manner that best shows potential purchasers what remnants are available and the quantity of remnant that is available.

Generally, rolls of flooring material are of such size and weight that they require the use of powered machines to safely and effectively move one or more rolls of the material. The typical powered machine is a forklift having one or more prongs suitable for lifting a pallet with rolls of flooring material securely placed thereon. Although the prongs on the forklift can be used to directly lift one or more rolls of flooring material, this method of moving flooring material rolls is not generally used because of the high risk of damaging the flooring material. Instead, because the rolls of flooring materials delivered by the manufacturer are configured with an internal longitudinal bore, many wholesalers and retailers utilize an outwardly extending stinger attachment that is configured to be attached to the forklift in place of the prongs and to be received by the longitudinal bore. Like the prongs it replaces, the stinger moves up and down the face of the forklift. In this manner, rolls of flooring material, including the remnants, are relocated by inserting the stinger into the longitudinal bore, raising the stinger as necessary, moving the roll of material to the desired location, lowering the stinger/roll as necessary and withdrawing the stinger from the roll.

Unfortunately, not all flooring materials are provided in rolls having a longitudinal bore therethrough. For instance, rolls of carpet pad generally do not have an internal bore and, therefore, cannot be moved with the stinger attached to the forklift. In addition, other flooring related materials or other materials and equipment in the wholesaler's or retailer's storage facility, store or other place of business are stored on pallets configured for the prongs of the forklift or otherwise either require or are more easily handled by the prongs of the forklift instead of the stinger attachment. As such, it is necessary to switch between the prong and stinger attachment on the forklift. The process of switching between the forklift prongs and the stinger attachment is time consuming and can be relatively difficult, in part due to the 250 to 350 pound weight of the stinger, depending on the type of forklift, prongs and stinger utilized. Although it would be possible to have two or more forklifts, at least one with a stinger and at least one with prongs, most flooring materials businesses do not have more than one forklift (due primarily to the cost of forklifts).

Racks for beneficially displaying rolls of flooring material have been in use for some time. One such rack is set forth in U.S. Pat. No. 4,783,017 to Ovitz, III, et al., which discloses a carpet rack having a frame for receiving multiple spindle assemblies, each of which are configured to horizontally support a roll of carpet thereon. Although the rack is shown with wheel assemblies, the rack does not include any mechanism to move the rack with a forklift. In U.S. Pat. Nos. 4,004,701 and 3,951,276, both to Moses, a storing and handling apparatus and system for rolls of floor covering is disclosed. In conjunction with a storage and dispensing rack, the Moses patents disclose the use of a pallet having box members spaced apart a distance which corresponds to the prongs of a conventional forklift. Other racks or storage devices are known to include an assembly suitable for receiving and moving the rack or device with the prongs of a forklift.

Nothing in the prior art presently known to the inventor discloses or suggests the use of a stinger attachment to move a storage and display rack adapted for storing and displaying flooring materials in either a vertical or horizontal manner. In fact, to the best of the inventor's present knowledge, the stinger attachment is only utilized to move individual rolls of flooring materials, not racks having one or more rolls of such material and not for materials, such as carpet pads, that do not have a longitudinal bore for receiving the stinger. As a result, a significant amount of time and effort is wasted changing between the prongs of the forklift and the stinger attachment. Therefore, what is needed is a moveable storage and display rack that is configured to be moved with a stinger attachment and which is suitable for storing and displaying flooring materials in either a horizontal or vertical arrangement. The preferred rack should be relatively inexpensive to make, easy to use and adaptable to current forklift equipment. Preferably, such a rack should additionally include a mechanism to connect to the forklift prongs, a mechanism to secure the flooring materials to the rack and a mechanism to guide the rack when moving it without lifting.

SUMMARY OF THE INVENTION

The storage and display rack of the present invention solves the problems identified above. That is to say, the present invention discloses a new and useful storage and display rack for rolled flooring materials that is moveable with either the prongs of a forklift or a stinger attached to the forklift. The storage and display rack of the present invention is suitable for storing and displaying one or more rolls of flooring materials in a vertical or horizontal configuration. Either the prongs or the stinger attachments of the forklift can be utilized to move the rack while the one or more rolls of flooring material are securely placed thereon.

In the preferred embodiment of the present invention, the moveable storage and display rack of the present invention comprises a frame having a plurality of frame members and a stinger receiving mechanism for receiving a stinger attached to a lifting device, such as a forklift and the like. The frame forms an upper section and an opposing bottom section and a first end and an opposing second end. The frame should be sized and configured to hold the desired flooring materials, including rolls of carpet, carpet remnants, carpet pad, linoleum and the like. The stinger receiving mechanism is preferably located at the upper section of the frame and configured to permit the stinger to lift the frame without any substantial swaying or other undesirable movement of the frame. In the preferred embodiment, the rack also includes a prong receiving mechanism, such as a pair of box members fixedly attached to the bottom section of the frame, configured to receive one or more prongs that can be attached to the lifting device (generally in place of the stinger). The preferred embodiment also has a one or more securing mechanisms to secure the flooring materials in or to the frame, such as an upper securing mechanism at the upper section of the frame for securing the flooring materials in a vertical configuration and one or more lower securing means disposed between the bottom section and the upper section of the frame to secure the flooring materials in the frame.

In one embodiment, the stinger receiving means comprises a shaped portion of the upper section of the frame, such as an inverted "U" or "V" shape at the top of a generally triangularly shaped upper section. In another embodiment, the stinger receiving means comprises a separate shaped member fixedly attached to the upper section of the frame, preferably at each end of the frame so that the stinger may pass through the shaped members and lift the frame. In yet another embodiment, the stinger receiving means comprises a tubular member fixedly attached to the upper section of the frame.

The rack can also include one or more roll support members attached to the frame, such as a pair of such roll support members with one of the pair attached to the first end of the frame and one of the pair of roll support members is at the second end of the frame, so as to longitudinally support a roll of the flooring materials on the frame. The rack can also include one or more movement guides attached to the bottom section of the frame and a plurality of wheels below the frame so that the rack may be moved along the ground by merely inserting the stinger into the movement guide and guiding the rack to its desired location. The rack can also include an upper extension member at the upper section of the frame and a bottom opening at the bottom section of the frame so that the racks may be stacked on top of each other. Preferably, the upper extension member of a first rack is angled or otherwise configured to be somewhat self-guiding into the bottom opening of a second rack that is being placed on top of the first rack.

Accordingly, the primary objective of the present invention is to provide a storage and display rack for rolled flooring materials that overcomes the disadvantages associated with the presently available storage and display racks for such materials.

It is also an important objective of the present invention to provide a storage and display rack that has a stinger receiving mechanism for receiving a stinger attached to a forklift or other lifting device so as to permit the lifting device to move the rack with the stinger attachment.

It is also an important objective of the present invention to provide a storage and display rack that utilizes a prong receiving mechanism suitable for facilitating stacking of racks on top of each other.

It is also an important objective of the present invention to provide a storage and display rack that comprises a frame having a plurality of frame members configured to store and display flooring materials in either a vertical or a horizontal arrangement.

It is also an important objective of the present invention to provide a storage and display rack that comprises a prong receiving mechanism for receiving the prongs of a forklift or other lifting device so as to move the rack with the lifting device.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
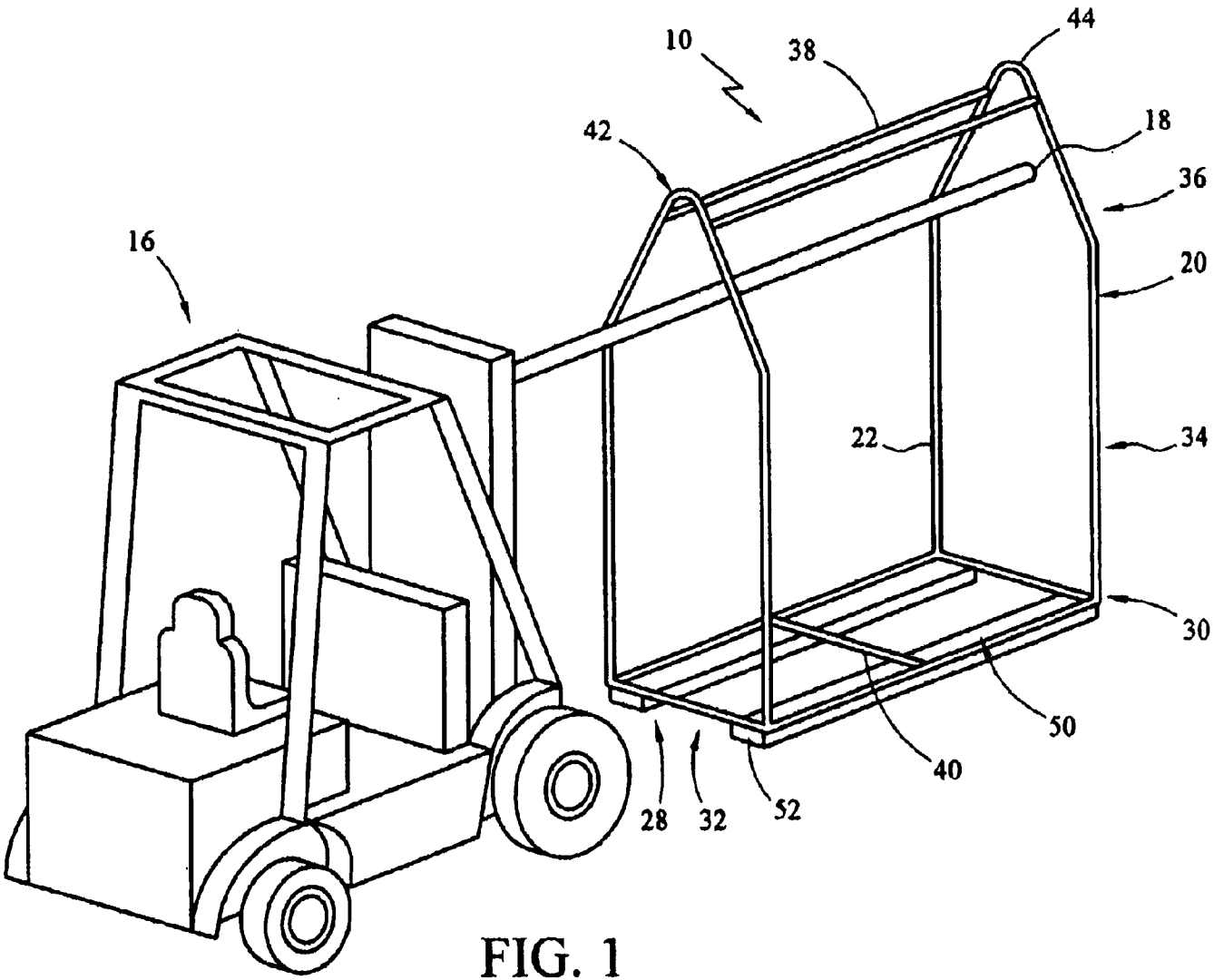
FIG. 1 is a perspective view of one embodiment of a storage and display rack of the present invention.

With reference to the figures where like elements have been given like numerical designations to facilitate the reader's understanding of the present invention, the preferred embodiments of the present invention are set forth below. In the preferred embodiment of the present invention, the storage and display rack of the present invention, identified generally as 10, is useful for beneficially storing and displaying one or more rolls of carpet 12 (FIG. 3), carpet pads 14 (FIG. 4) or other flooring materials, as defined above, and being moved by a forklift 16 or other lifting device having a stinger 18 or standard forklift prongs (not shown) attached thereto. As is well known, carpet 12 typically comes in rolls approximately twelve feet long and weighing as much as 150 pounds, depending on the types of materials used for the carpet. Carpet pad 14, on the other hand is typically approximately six feet long and weighs approximately forty-five pounds. Naturally, stinger 18 and forklift 16 must be of sufficient strength to lift rack 10 when full of carpet 12, pad 14 and/or other flooring materials.

Figure 2:
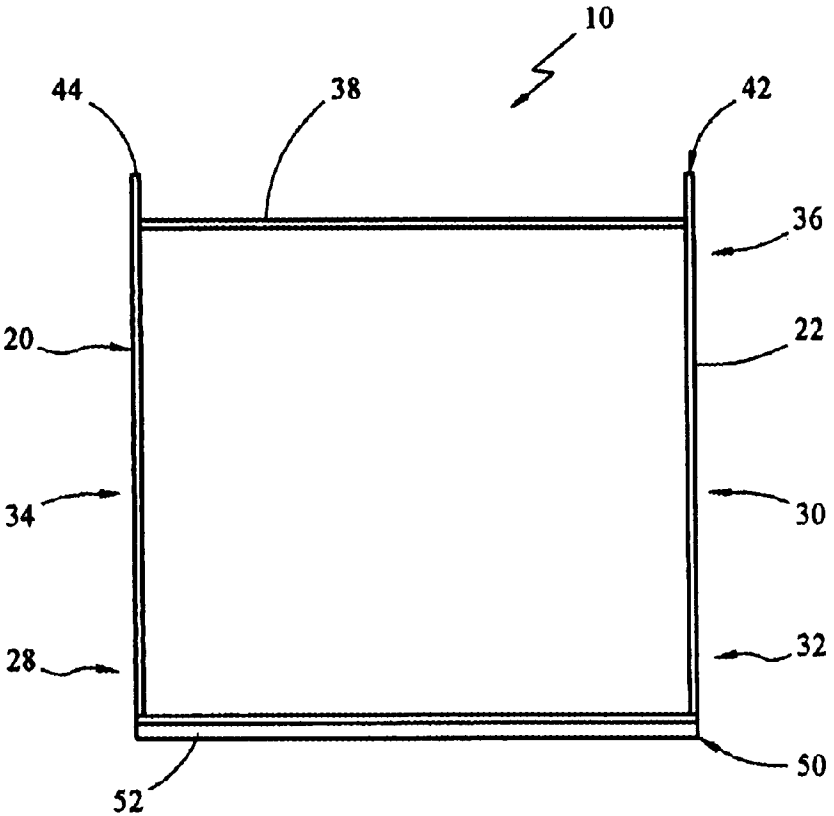
FIG. 2 is a side view of the embodiment of the storage and display rack of the present invention of FIG. 1.

The storage and display rack 10 of the present invention has frame 20 made up of a plurality of frame members 22 configured to form a first side 24, second side 26, first end 28 and second end 30, as best shown in FIGS. 1 and 2 included herewith. Frame members 22 of frame 20 are formed into bottom section 32, sides 34 and upper section 36 to allow rack 10 to store and display flooring materials, including carpet 12 and pad 14. Although frame 20 can be, made from a single integral member or a combination of integral members, the preferred embodiment has frame 20 made from the plurality of individual frame members 22 which are welded, bolted or otherwise joined together, as may be appropriate for the materials of frame members 22. Frame members 22 can be made from steel bars, tubular steel, composite materials, fiberglass or other materials having sufficient strength and stiffness for the loads resulting from its own weight and that of multiple rolls of carpet 12, pad 14 and/or other flooring materials. Because the rack 10 may be utilized in outdoor environments, as described below, the frame 20 should be made from materials suitable for outdoor exposure or sufficiently coated or treated to avoid corrosion.

Figure 5:
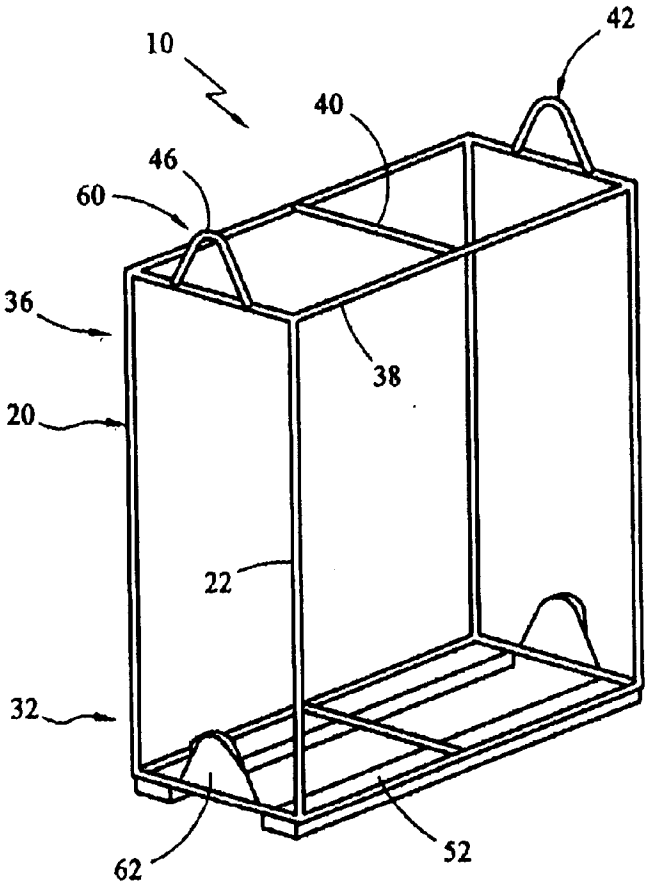
FIG. 5 is a perspective view of an alternative embodiment of the storage and display rack of the present invention showing the use of separate end pieces for receiving the stinger attachment.

As shown in FIGS. 1 and 2, bottom section 32 of frame 20 can be generally rectangular shaped and formed from four or more frame members 22. Side 34 of frame 20 can comprise frame members extending generally upwardly from bottom section 32 and interconnecting with upper section 36. Upper section 36 can be generally rectangular shaped, as shown in FIG. 5, or generally triangular shaped (as viewed from ends 28 and 30), as shown in FIGS. 1 and 2. As may be necessary depending on the strength of frame members 22, longitudinal stiffeners 38 or transverse stiffeners 40 can be used in bottom section 32, sides 34 or upper section 36 to provide structural integrity to frame 20 so that it may be lifted and moved as needed and able to sufficiently support itself, with or without any flooring materials. Generally, it will be beneficial to configure frame 20 such that first side 24 and second side 26 are functionally interchangeable so that the user of rack 10 does not have to concern himself or herself with a front or back placement of rack 10. Likewise, it will be beneficial to configure rack 10 such that first end 28 and second end 30 are also functionally interchangeable so that the user may approach and move rack 10 equally from either first end 28 and second end 30.

Upper section 36 includes a stinger receiving mechanism, shown generally as 42, for receiving the stinger 18 extending outwardly from forklift 16. As shown in FIGS. 1 and 2, stinger receiving mechanism 42 can comprise a shaped portion 44 of upper section 36 that is shaped and configured to interact with stinger 18 so as to allow stinger 18 to pick up rack 10 off the ground or other surface and move it to another location without significant swaying or other undesirable motion of rack 10. As shown, shaped portion can be in the shape of an inverted "U" or it can be more of an inverted "V" shape. The inverted "U" shape, with the top of the inverted "U" configured to have a radius or arch portion slightly larger than that of stinger 18, is preferred due to the additional stability it provides. When correctly configured, stinger 18 should move upward, due to action by forklift 16, into shaped portion 44 and interact with it to prevent swaying of rack 10. A shaped portion 44 in the shape of an inverted "U", without the transverse members 40 described in several of the alternative embodiments below, is preferred due to the ability of the stinger 18 to be inserted into the center of rack 10 and then moved upward without the need to "aim" the stinger 18 into a relatively small opening.

As shown in the embodiment of FIG. 5, stinger receiving mechanism 42 can comprise shaped member 46 fixedly attached to or integral with frame member 22 at the upper section 36 of each end 28 and 30. In this configuration, shaped member 46 can also be in an inverted "U" or "V" shape having a radius or arch configured to interact with stinger 18 to allow the user to lift rack 10 without any undue swaying or other undesirable effect. Alternatively, shaped member 46 can be in the form of a ring or short tubular member, having a circular, square, rectangular or other cross-section, attached to frame member 22. Shaped member 46 can be made out of tubular steel or other materials suitable for attachment to frame member 22 and can be attached either above or below frame member 22 of upper section 36. Depending on the materials utilized for frame member 22 and shaped member 46, they may be connected by welding, bolts, screws, rivets or other appropriate mechanism. As stated above, the primary disadvantage of this type of stinger receiving mechanism 42 is that the stinger must be "aimed" into the space between the shaped member 46 and frame member 22.

Figure 6:
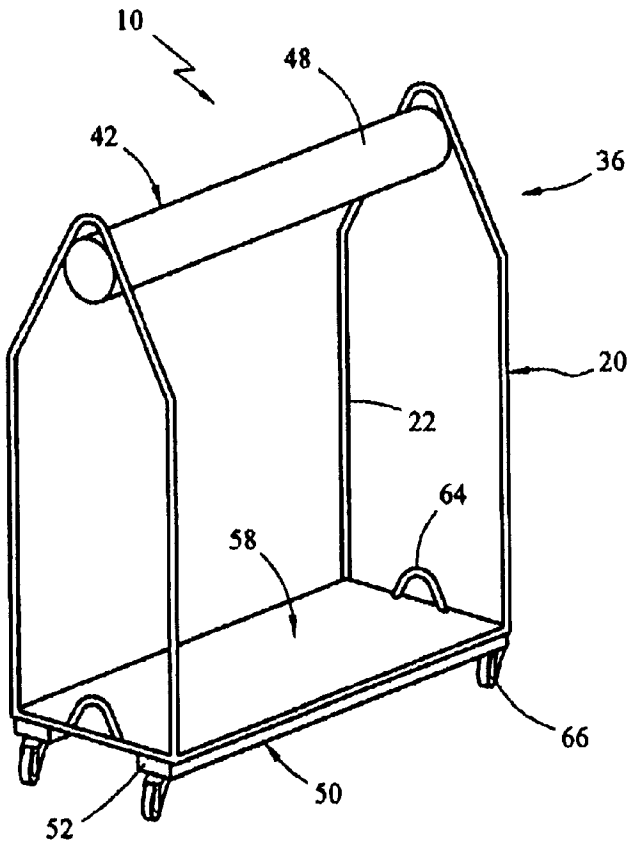
FIG. 6 is a perspective view of another alternative embodiment of the storage and display rack of the present invention showing a tubular member configured for receiving the stinger attachment and a floor.

Yet another embodiment for stinger receiving mechanism 42 is shown in FIG. 6. In this embodiment, stinger receiving mechanism 42 is a tubular member 48 extending substantially the full longitudinal length of rack 10 and connecting to the frame members 22 of upper section 36 of ends 28 and 30. In the preferred configuration of this embodiment, the inside diameter of tubular member 48 is selected to be only moderately larger than the outer diameter of stinger 18, such as the diameter utilized for the interior longitudinal bore of the rolls of carpet 12 or other flooring materials. Tubular member 48 can be configured to be below or above frame members 22 at ends 28 and 30 and can have a circular, rectangular, square or other cross-section. As stated above, the primary disadvantage of this type of stinger receiving mechanism 42 is that the stinger must be "aimed" into tubular member 48.

The stinger receiving mechanisms 42 described above allow rack 10 to be lifted and moved with the stinger attached to forklift 16 or other lifting device. To allow for the situation where it is desired to move rack 10 but the prongs are attached to the forklift 16 instead of stinger 18, rack 10 can further comprise a prong receiving mechanism, shown generally as 50, for receiving the one or more prongs on forklift 16 to allow rack 10 to be lifted and moved with the prong or prongs of forklift 16. Including prong receiving mechanism 50 in rack 10 avoids having to remove stinger 18 for the prongs when they are needed. As shown in the figures, prong receiving mechanism 50 can comprise a pair of generally rectangular box members 52 shaped and configured to receive the forklift prongs and attached to the frame members 22 comprising bottom section 32. Box members 52 can extend substantially the full longitudinal length of rack 10 or they can be one or more short sections located at either end 28 or 30 and/or positioned at or near the middle of frame 20. As with shaped member 46, box members 52 can be made out of tubular steel or other materials suitable for attachment to frame member 22 and can be attached either above or below frame member 22 of upper section 36. Depending on the materials utilized for frame member 22 and box member 52, they may be connected by welding, bolts, screws, rivets or other appropriate mechanism. As an alternative to box members 52, prong receiving mechanism 50 can comprise a generally "C" or "U" shaped member attached to the bottom or top of frame member 22 making up bottom section 32. As with the stinger receiving mechanism 42, prong receiving mechanism 32 should be sized and configured to be able to allow the forklift prongs to raise and move rack 10 even when it is full of carpet 12, pad 14 or other flooring materials.

Figure 3:
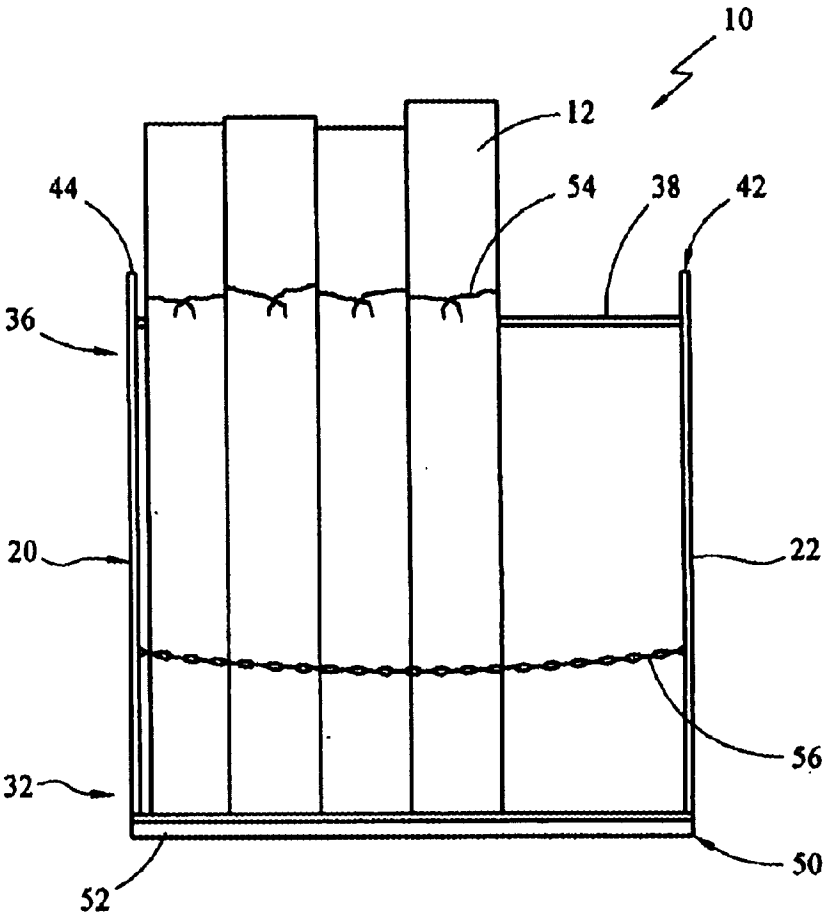
FIG. 3 is a side view of the embodiment of the storage and display rack of the present invention of FIG. 1 showing use with rolls of carpet or carpet remnants.
Figure 4:
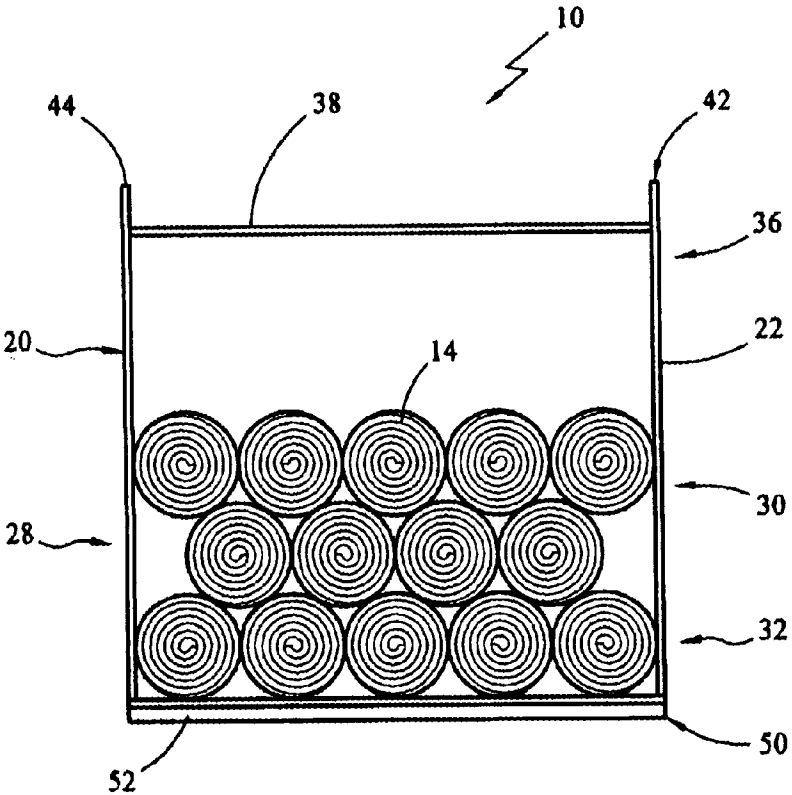
FIG. 4 is a side view of the embodiment of the storage and display rack of the present invention of FIG. 1 showing use with rolls of carpet pad.

In order to safely store, move and display carpet 12 in a vertical configuration, as shown in FIG. 3, it is necessary to provide one or more securing mechanisms to prevent carpet 12 from falling off of rack 10. As shown in FIG. 3, the securing mechanism can comprise an upper securing mechanism 54 at or near upper section 36 of frame 20 and/or lower securing mechanism 56 nearer the middle or bottom section 32 of frame 20. Upper securing mechanism 54 can comprise, as shown in FIG. 3, a one or more individual tie members suitable for securely tying a vertical roll of carpet 12 to an upper section frame member 22 so as to prevent the roll of carpet 12 from falling off of or outward from rack 10 during storage, movement or display. Individual tie members, such as strong string, cord, rope, plastic ties, chain or the like, are preferred because it allows the user to undo one tie at a time to remove one roll of carpet 12 at a time. In the preferred embodiment, upper securing mechanism 54 is a tie that attaches to or connects to an upper section frame member 12, such as a longitudinal stiffener 38. Alternatively, one end of an upper securing mechanism 54 can pass through a loop member (not shown) and connect to the other end of the upper securing mechanism 54 by locking, tying, hooking or by use of other connecting devices. Lower securing mechanism 56 should be configured to prevent the bottom of the roll of carpet 12 from "kicking out" of frame 20. As with upper securing mechanism 54, lower securing mechanism 56 can be strong string, cord, rope, plastic ties, chain or the like that crosses from a frame member 22 at first end 28 to a frame member 22 at second end 30 or which meets between ends 28 and 30. In the preferred embodiment, lower securing mechanism 56 is a chain.

Rack 10 of the present invention can also comprise a separate floor 58 at the bottom section 32 of frame 20, particularly for stacking carpet rolls in the vertical configuration shown in FIG. 3. Although frame members 22 and/or prong receiving mechanism 50 can serve as a "floor", for certain types of flooring materials, a floor 58 that substantially extends from first side 24 to second side 26 and first end 28 to second end 30 provides significant benefits for moving certain types of materials or moving rolls of carpet 12 in a vertical configuration. Use of floor 58 provides a more complete surface on which to place materials and can assist with achieving a stable frame 20 by helping to prevent twisting or other undesirable movement of frame 20. Floor 58 can be made out of the same materials used for frame 24 or a lighter weight strong material to provide a strong floor without adding much weight to rack 10.

In the preferred embodiment, rack 10 is made to stack on top of another rack 10. This can be accomplished by providing an upper extension member 60 that is configured to interact with the bottom section 32 of frame 20. In the preferred embodiment, upper extension member 60 is configured to be part of stinger receiving mechanism 42, particularly in the embodiments shown in FIGS. 1 and 5, which utilize the shaped portion 44 and shaped member 46, respectively. The shaped portion 44 or shaped member 46 can be configured to fit into a bottom opening 62 in frame member 22 at the ends 28 and 30 of bottom section 32. As is known in the art, it is preferred that upper extension member 60 be angled inward towards rack 10 so that it is in effect self-guiding into bottom opening 62. Naturally, frame 20 of rack 10 must be sized and configured to be able to withstand the loads from one or more racks 10 stacked on top of it, each one being full of carpet 12, pad 14 and/or other flooring materials.

Also in the preferred embodiment, rack 10 has one or more movement guides 64 attached to frame 20. Preferably, movement guides 64 are attached to a frame member 22 at both ends 28 and 30 of bottom section 32, as shown in FIG. 6. Movement guides 64 are configured to receive stinger 18 so as to allow the user of rack 10 to move rack 10 from one location to another without the need of lifting rack 10 off the ground. The stinger 18 can be stabbed into one or more of the movement guides 64 and the forklift 16 operated so as to slide rack 10 to the desired location. To assist in this endeavor, it is preferred that rack 10 comprise wheels 66 at the bottom section 32. Preferably, wheels 66 are configured to be of the castor type that allows pivoting of the wheels in any direction which the user desires to move rack 10.

Figure 7:
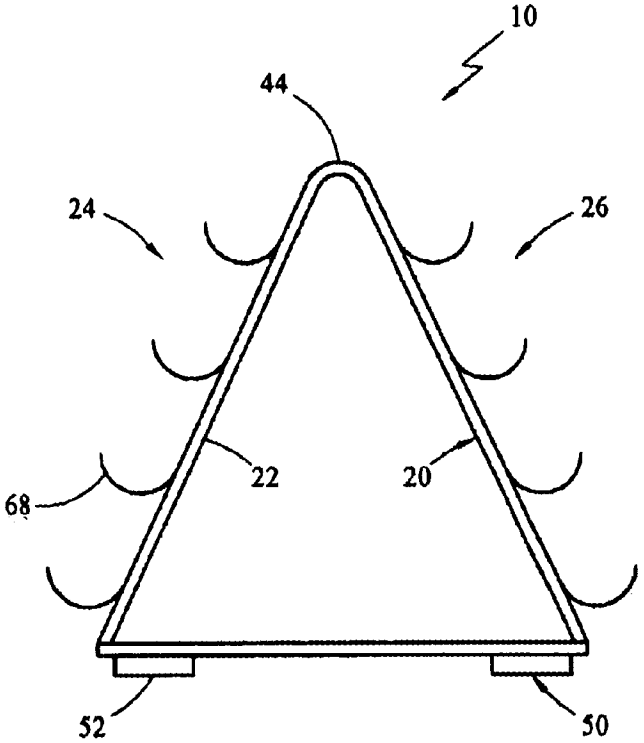
FIG. 7 is an end view of yet another alternative embodiment of the storage and display rack of the present invention showing the use of multiple roll supporting members on the frame.

In another embodiment of the present invention, shown in FIG. 7, rack 10 comprises one or more roll support members 68 attached to frame member 22 along sides 34. In this embodiment, it is preferred that frame members 22 at sides 34 angle in from the bottom section 32 toward the upper section 36, as shown in FIG. 7. Roll support members 68 should be sized and configured to receive and securely support a full roll of carpet 12 or other flooring material thereon. This allows the user of rack 10 to store and display multiple rolls of carpet 12 or other materials on rack 10. As shown, roll support members 68 can be located both inside and outside of frame 10. Alternatively, roll support members can be utilized on only the inside or only the outside of frame 10, in whatever combinations desired by the manufacturer of rack 10. Roll support members 68 can be made out of the same material for frame members 22 or different materials can be used. If preferred, roll support members 68 can be coated or covered in a separate material that is suitably selected to prevent damage to the roll of carpet 12 or other materials.

In use, the rack 10 of the present invention eliminates the need to alternate between the prongs or the stinger 18 attached to a forklift 16 or other lifting apparatus when it is desired to move rack 10 from one location to another. If the stinger 18 is attached to the forklift 16, as it typically is when moving a single roll of carpet, the user merely has to slide the stinger 18 into either frame 20 and move it upward until it connects with shaped portion 44 or slide it into the space provided by shaped member 46 or tubular member 48. Once in place, upward movement of stinger 18 by appropriately controlling forklift 16 will result in lifting rack 10 off the ground or other surface upon which it sits. Rack 10 can then be moved to the desired location. Once in place, carpet 12, pad 14 and/or other flooring materials can be displayed on rack 10. Rack 10 makes it particularly easy for the wholesaler-or retailer who has carpet 12 or carpet remnants he or she wants to sell to store the remnants on rack 10, move rack 10 and the materials thereon out to a more visible location, such as outdoors, during the store's open hours and then move it back into the building or to its stored location in the building when the store closes.

While there are shown and described herein certain specific alternative embodiments of the invention, it will be readily apparent to those skilled in the art that the invention is not so limited, but is susceptible to various modifications and rearrangements in design and materials without departing from the spirit and scope of the invention. Hence, it is to be understood that the invention is capable of variation and modification within the scope of the appended claims. In particular, it should be noted that the present invention is subject to modification with regard to the dimensional relationships set forth herein and modifications in assembly, materials, size, shape and use.

What is claimed is:

1. A rack in combination with a lifting device having a stinger attached thereto, said rack for storing, moving and displaying one or more rolled flooring materials thereon, the one or more rolled flooring materials configured to be lifted and moved by said stinger, said rack comprising:

a frame having a plurality of frame members, said frame forming an upper section and an opposing bottom section, said frame sized and configured to store, move and display the flooring materials thereon; and stinger receiving means at said upper section of said frame for receiving said stinger to lift and move said frame, said stinger receiving means configured to permit said stinger to lift said frame without substantial swaying or other undesirable movement of said frame;

whereby said stinger is selectively inserted into a roll of the one or more rolled flooring materials to move the roll of flooring material or received into said stinger receiving means to lift and move said rack with or without the one or more rolled flooring materials disposed on said rack.

2. The rack according to claim 1 further comprising prong receiving means at said bottom section of said frame for receiving one or more prongs attached to said lifting device.

3. The rack according to claim 2, wherein said prong receiving means comprises a pair of box members fixedly attached to said frame.

4. The rack according to claim 1, wherein said stinger receiving means comprises a shaped portion of said upper section of said frame.

5. The rack according to claim 4, wherein said upper section of frame is generally triangular in shape.

6. The rack according to claim 1, wherein said stinger receiving means comprises a shaped member fixedly attached to said upper section of said frame.

7. The rack according to claim 1, wherein said stinger receiving means comprises a tubular member fixedly attached to said upper section of said frame.

8. The rack according to claim 1 further comprising one or more upper securing means at said upper section of said frame for securing the flooring materials in a vertical configuration in said frame.

9. The rack according to claim 1, wherein said upper securing means attach the flooring materials to a longitudinal stiffener disposed between a first end and an opposing second end of said frame.

10. The rack according to claim 1 further comprising one or more lower securing means disposed between said bottom section and said upper section of said frame for securing the flooring materials in said frame.

11. The rack according to claim 1 further comprising one or more roll support members attached to said frame, said one or more roll support members configured to freely support said one or more rolled flooring materials in a generally horizontal position.

12. The rack according to claim 1 further comprising a pair of roll support members attached to said frame, wherein one of said pair of roll support members is at a first end of said frame and one of said pair of roll support members is at an opposing second end of said frame for longitudinally supporting a roll of the flooring materials on said frame.

13. The rack according to claim 1 further comprising one or more movement guides attached to said bottom section of said frame and a plurality of wheels below said frame, said one or more movement guides shaped and configured to receive said stinger and facilitate movement of said rack on said plurality of wheels.

14. The rack according to claim 1 further comprising an upper extension member at said upper section of said frame and a bottom opening at said bottom section of said frame, said upper extension member and said bottom opening sized and configured to facilitate stacking of a plurality of said frames.

15. A rack in combination with a lifting device having a stinger attached thereto and with one or more rolled flooring materials stored, moved or displayed on said rack, the one or more rolled flooring materials configured to be lifted and moved by said stinger, said rack comprising:

a frame having a plurality of frame members, said frame forming an upper section and an opposing bottom section, said frame sized and configured to store, move and display the flooring materials thereon;

stinger receiving means at said upper section of said frame for receiving said stinger to lift and move said frame, said stinger receiving means configured to permit said stinger to lift said frame without substantial swaying or other undesirable movement of said frame;

prong receiving means at said bottom section of said frame for receiving one or more prongs attached to said lifting device; and securing means attached to said frame for securing the flooring materials in said frame.

16. The rack according to claim 15, wherein said prong receiving means comprises a pair of box members fixedly attached to said frame.

17. The rack according to claim 15, wherein said stinger receiving means comprises a shaped portion of said upper section of said frame.

18. The rack according to claim 15, wherein said stinger receiving means comprises a shaped member fixedly attached to said upper section of said frame.

19. The rack according to claim 15, wherein said stinger receiving means comprises a tubular member fixedly attached to said upper section of said frame.

20. The rack according to claim 15 further comprising one or more roll support members attached to said frame, said one or more roll support members configured to freely support said one or more rolled flooring materials in a generally horizontal position.

21. The rack according to claim 15 further comprising one or more movement guides attached to said bottom section of said frame and a plurality of wheels below said frame, said one or more movement guides shaped and configured to receive said stinger and facilitate movement of said rack on said plurality of wheels.

22. A rack in combination with a lifting device having a stinger attached thereto, said rack for storing, moving and displaying one or more rolled flooring materials thereon, the one or more rolled flooring materials configured to be lifted and moved by said stinger, said rack comprising:

a frame having a plurality of frame members, said frame forming an upper section and an opposing bottom section, said frame sized and configured to store, move and display the flooring materials;

stinger receiving means at said upper section of said frame for receiving said stinger to lift and move said frame, said stinger receiving means configured to permit said stinger to lift said frame without substantial swaying or other undesirable movement of said frame;

a pair of box members fixedly attached to said bottom section of said frame, said box members configured to receive one or more prongs attached to said lifting device;

an upper securing means at said upper section of said frame for securing the flooring materials in a vertical configuration in said frame; and one or more lower securing means disposed between said bottom section and said upper section of said frame for securing the flooring materials in said frame.

23. The rack according to claim 22, wherein said stinger receiving means comprises a shaped portion of said upper section of said frame.

24. The rack according to claim 22, wherein said stinger receiving means comprises a shaped member fixedly attached to said upper section of said frame.

25. The rack according to claim 22, wherein said stinger receiving means comprises a tubular member fixedly attached to said upper section of said frame.

* * * * *